US009332848B2

(12) United States Patent
Zanchetta

(10) Patent No.: US 9,332,848 B2
(45) Date of Patent: May 10, 2016

(54) PROCESS FOR FORMING A CONNECTING STRUCTURE BETWEEN THE COLUMN AND SEATING PORTION OF AN OFFICE CHAIR, AND A STRUCTURE OBTAINED BY SUCH PROCESS

(71) Applicant: Andrea Francesco Zanchetta, Bassano del Grappa (IT)

(72) Inventor: Andrea Francesco Zanchetta, Bassano del Grappa (IT)

(73) Assignee: IMARC S.P.A., Rossano Veneto (VI) (IT)

( * ) Notice: Subject to any disclaimer, the term of this patent is extended or adjusted under 35 U.S.C. 154(b) by 42 days.

(21) Appl. No.: 14/169,645

(22) Filed: Jan. 31, 2014

(65) Prior Publication Data

US 2014/0145493 A1 May 29, 2014

Related U.S. Application Data

(62) Division of application No. 13/257,299, filed as application No. PCT/EP2010/054851 on Apr. 14, 2010, now abandoned.

(30) Foreign Application Priority Data

Apr. 23, 2009 (IT) ..... VE2009A0023

(51) Int. Cl.

| | |
|---|---|
| ***A47B 97/00*** | (2006.01) |
| ***A47C 7/00*** | (2006.01) |
| ***A47C 1/032*** | (2006.01) |

(52) U.S. Cl.

CPC ..... *A47C 7/004* (2013.01); *A47C 1/03255* (2013.01)

(58) Field of Classification Search

CPC ..... A47C 3/24; A47C 3/30; A47C 7/004; A47C 1/03255

USPC ..... 297/463.1, 344.21, 344.12, 344.16, 297/301.1

See application file for complete search history.

(56) References Cited

U.S. PATENT DOCUMENTS

| | | | | |
|---|---|---|---|---|
| 5,131,718 | A * | 7/1992 | Cooper | 297/452.1 |
| 6,022,077 | A * | 2/2000 | Kirkland et al. | 297/344.19 |
| 6,174,031 | B1 * | 1/2001 | Lindgren et al. | 297/463.1 |
| 7,530,639 | B2 * | 5/2009 | Groelsma et al. | 297/423.38 |
| 8,167,373 | B2 * | 5/2012 | Allison et al. | 297/344.19 |
| 2002/0003367 | A1 * | 1/2002 | Wild | 297/300.1 |
| 2006/0147672 | A1 * | 7/2006 | Ruiz | 428/137 |
| 2008/0309135 | A1 * | 12/2008 | Machael et al. | 297/301.4 |

FOREIGN PATENT DOCUMENTS

| | | | | |
|---|---|---|---|---|
| EP | 0488278 | * | 11/1991 | A47C 1/032 |
| EP | 1709889 | A1 * | 10/2006 | A47C 3/026 |
| WO | WO 9723152 | A1 * | 7/1997 | A47C 1/024 |

* cited by examiner

*Primary Examiner* — Laurie K Cranmer
(74) *Attorney, Agent, or Firm* — Themis Law

(57) ABSTRACT

A method of forming a connecting structure between column and seating portion of an office chair includes the steps of forming a frusto-conical portion having a flange by cold-pressing a portion of sheet metal, inserting the flanged portion into a mold reproducing the shape of the structure, injecting plastic material into the mold and incorporating the flanged portion of the frusto-conical portion into the plastic material.

5 Claims, 5 Drawing Sheets

PROCESS FOR FORMING A CONNECTING STRUCTURE BETWEEN THE COLUMN AND SEATING PORTION OF AN OFFICE CHAIR, AND A STRUCTURE OBTAINED BY SUCH PROCESS

FIELD OF THE INVENTION

The present invention relates to a system for forming a connecting structure between the column and seating portion in office chairs, and a structure obtained by the method.

BACKGROUND OF THE INVENTION

Office chairs are known, generally consisting of a support base provided with wheels and a rotatable column of variable height, the upper end of which is inserted into a box support internally housing the adjustment mechanisms for the seating portion and back rest.

These structures are subjected to intensive use and consequently have to be able to resist the tests required by international regulations of this sector.

One of the points most subjected to structural stresses is the connection between the structure and the rotatable column, which generally consists of a traditional gas spring enabling the seating portion to be height adjusted. Generally the connection between the column and the structure is obtained by a male conical part provided in the head of the column and insertion-fitted into a corresponding female conical part obtained in the structure.

A first known type of box support is obtained by die-casting aluminum.

However, this structure has the drawback of a high cost due to the materials used, to the die-casting operations, and to the metal structure finishing operations and the grinding of tolerance holes.

Moreover, all the holes in which pins rotate require the use of costly self-lubricating sockets to prevent seizure and jamming of movements.

Chair structures have also been obtained by pressing sheet metal parts followed by welding the steel sockets.

This solution has however the drawback of high cost due to welding and painting operations.

Moreover, with this solution, self-lubricating sockets again have to be used, and the pieces obtained are considerably limited in terms of shape.

Products have also been proposed with an integral plastic structure or with steel cones fitted together or over-molded, but the structural characteristics are insufficient for intensive product use. Moreover the cost of this possible conical component, usually obtained by lathe turning or from a tube, is high.

The object of the invention is to eliminate these drawbacks by providing a structure for office chairs which is simple, comfortable and highly reliable.

SUMMARY OF THE INVENTION

This object is attained according to the invention by a method for forming connecting structures between the column and seating portion of office chairs as described hereinafter.

BRIEF DESCRIPTION OF THE DRAWINGS

The present invention is further clarified hereinafter with reference to the accompanying drawings, in which.

DETAILED DESCRIPTION OF EMBODIMENTS OF THE INVENTION

Figure 1:
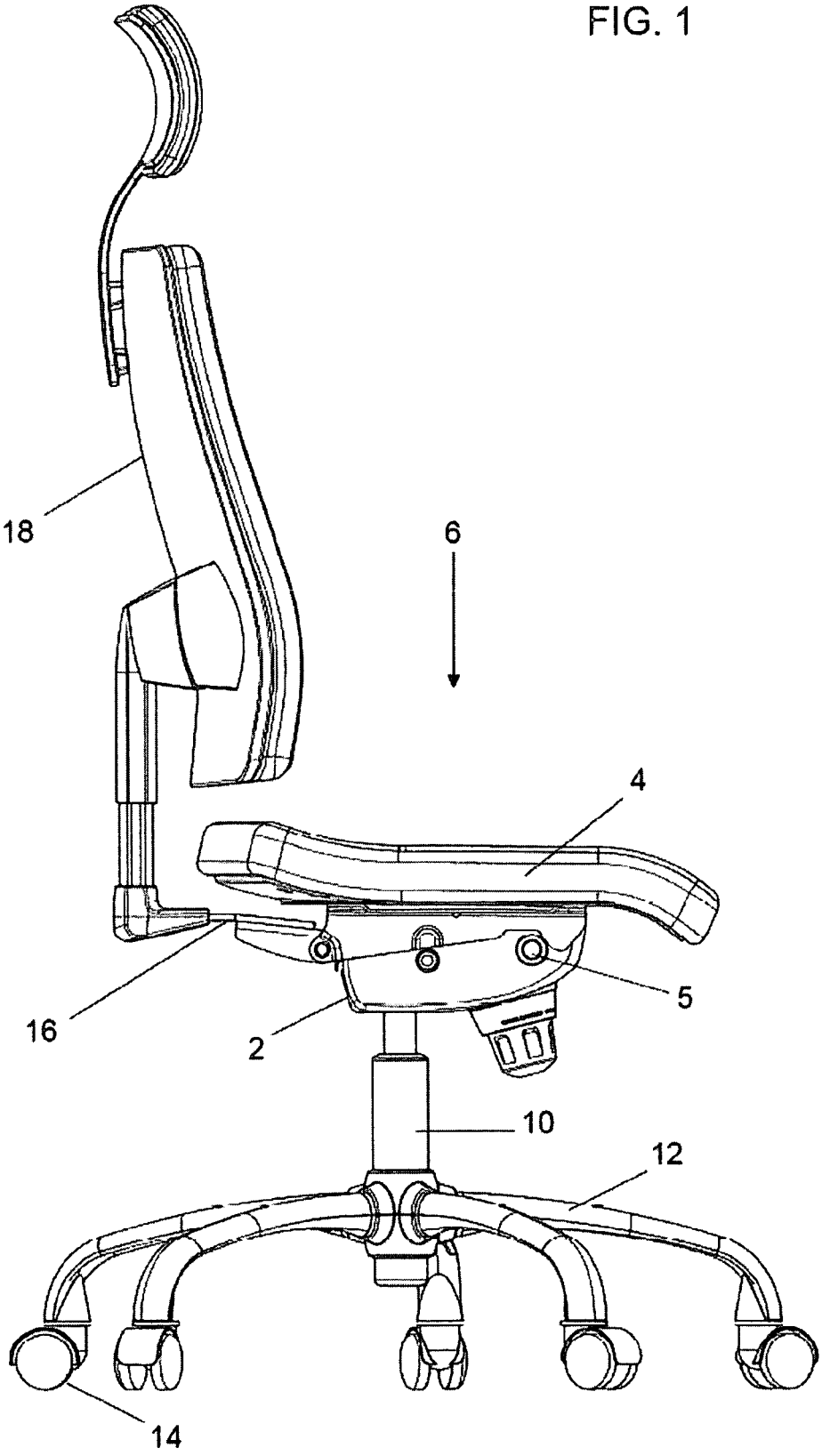
FIG. 1 is a perspective view of a chair provided with the structure of the invention.

As it can be seen from the figures, the structure of the invention, indicated overall by 2, is applied to the lower part of the seating portion 4 of an office chair 6 and is provided with a frusto-conical socket 8 for insertion-fitting the upper end of a traditional gas spring 10, the function of which is to support the structure 2 on a support base 12 with wheels 14, and at the same time to regulate the height of the seat.

The arm 16 for supporting the back rest 18 of the chair 6 is also hinged to the structure 2. A lever 5 for adjusting the mechanism is also connected to the structure 2.

The box support is formed by injection molding plastic material, preferably polyamide filled with glass fiber, the frusto-conical socket 8 being formed by pressing sheet metal.

The structure is provided internally with a plurality of reinforcement ribs 36 which connect the frusto-conical part of the metal portion to the side walls in order to stiffen the structure. To reduce the overall size during transport, the structure is provided with an element 20 for quick-coupling the control lever 5, which can be easily mounted at the destination. In the plastic side walls, seats 22 and 23 are provided for housing passage pins 38 and 40 for the adjustment members. The metal pins can be mounted in this manner without the risk of seizure problems arising or without the need to mount additional sockets.

Figure 2:
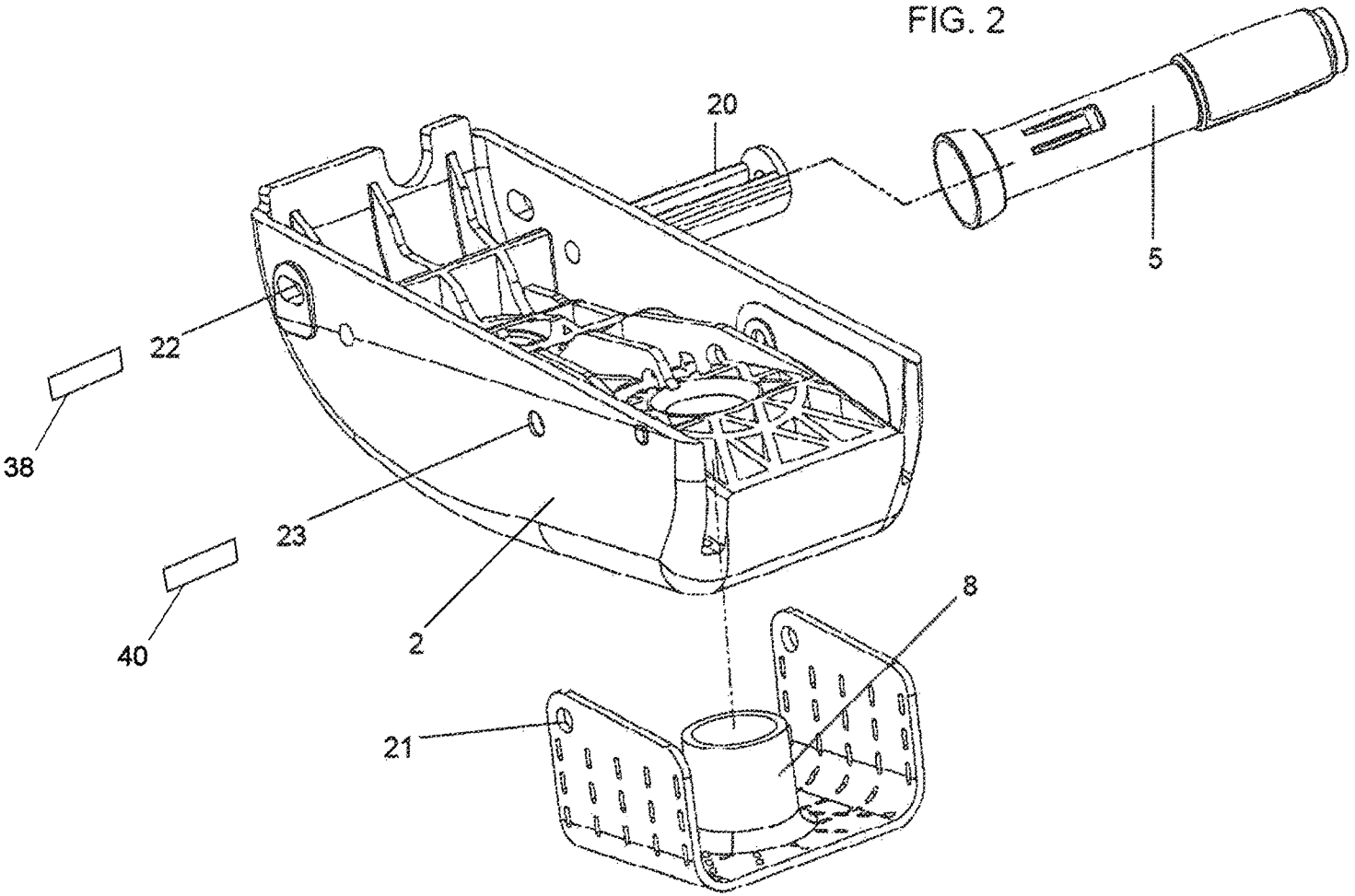
FIG. 2 is an exploded perspective view of the lower part of the box support.
Figure 3:
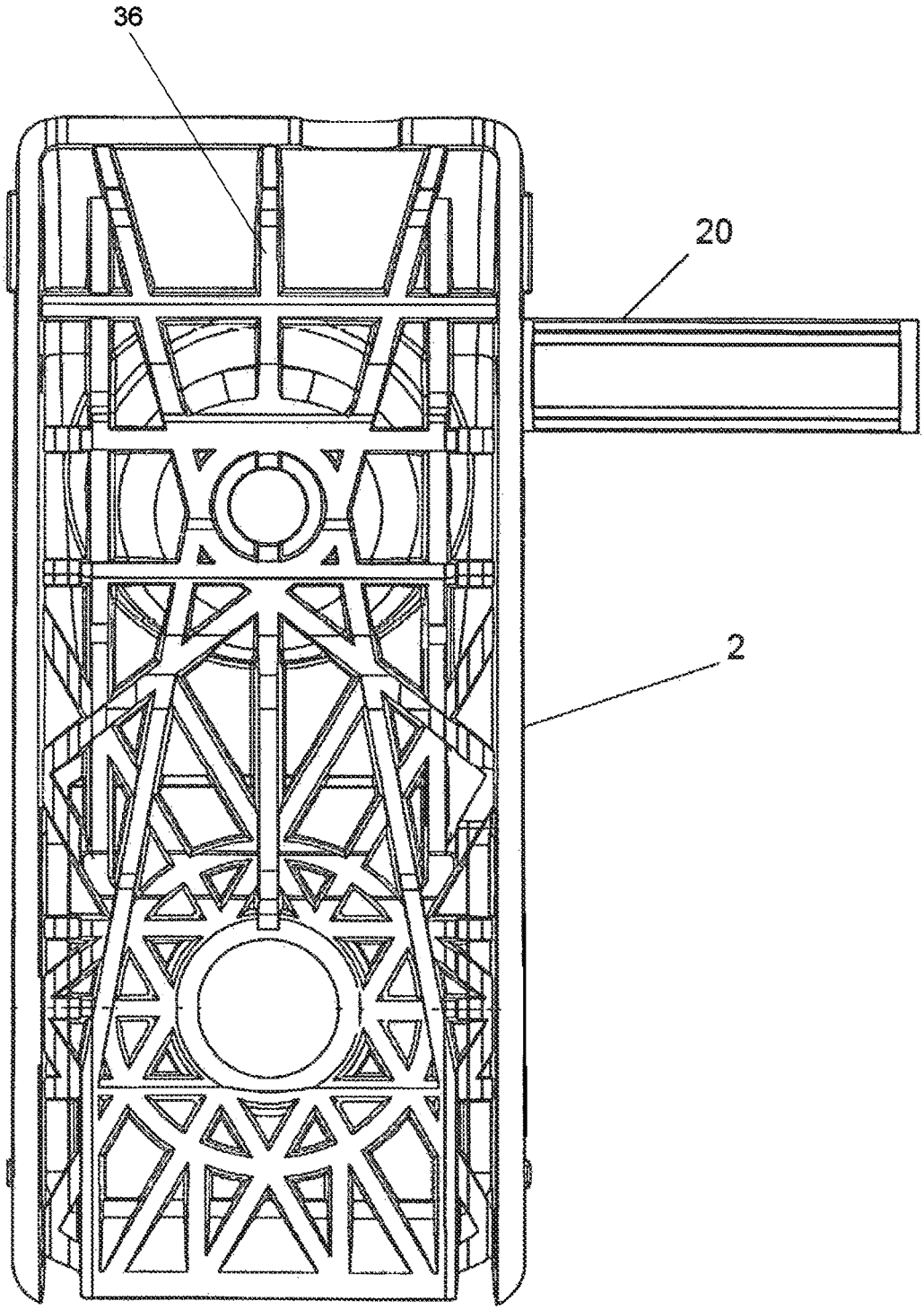
FIG. 3 is a plan view thereof.
Figure 4:
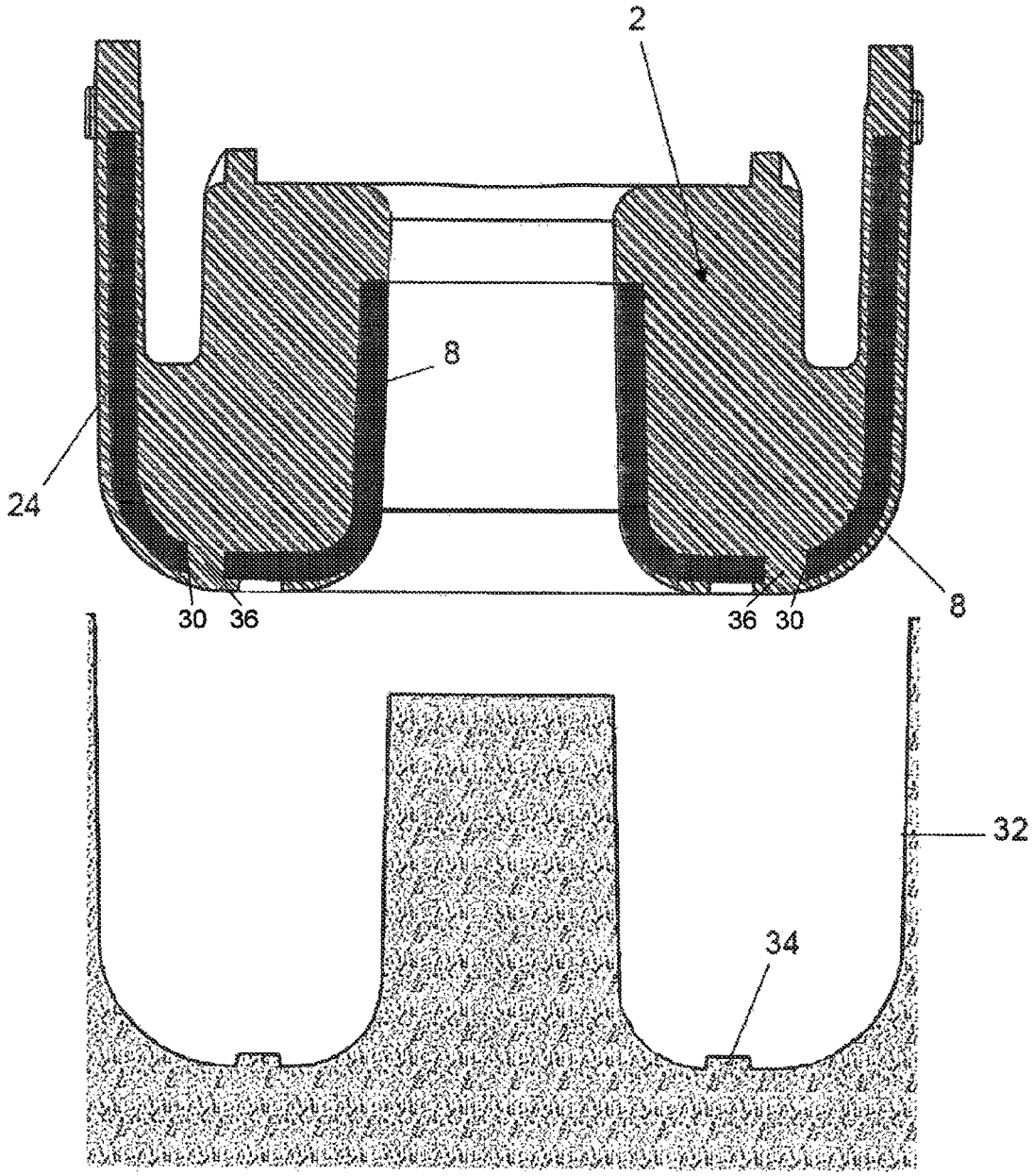
FIG. 4 is a schematic longitudinal section showing the step of extracting the structure from the mold.
Figure 5:
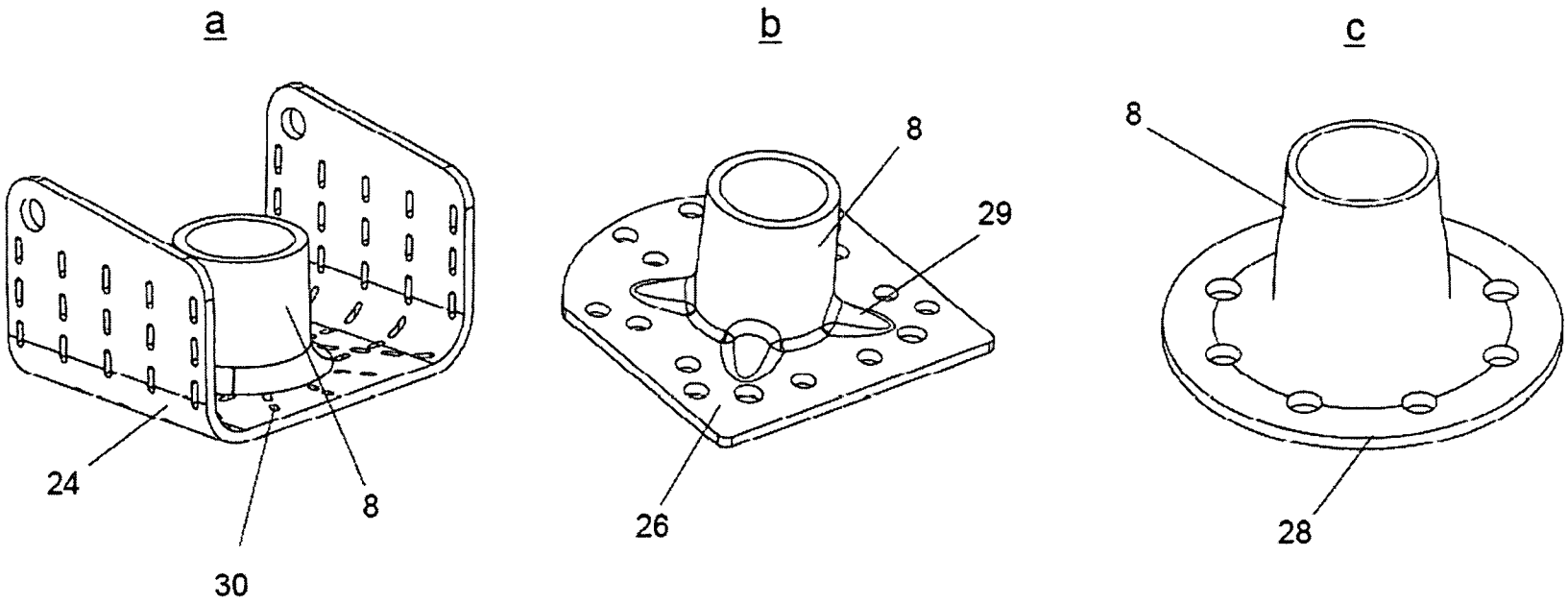
FIGS. 5*a*, 5*b* and 5*c* show three different embodiments of the metal insertion joint.

The socket 8 for mounting on the head of the column 10 can be provided with a U-shaped flange 24, see FIGS. 2 and 5*a*, or a flat flange of traditionally square shape 26 (FIG. 5*b*) or of circular shape 28 (FIG. 5*c*), perfectly symmetrical to simplify orientation in the case of automatically loading the piece to be over-molded into the mold. The pressed sheet metal piece can also comprise reinforcement bosses 29 to stiffen the connection between the conical portion and the base flange (FIG. 5*b*).

Of whatever shape this flange is formed, it comprises a plurality of holes 30 for enabling a more effective grip during injection molding. If the passage holes for the plastic correspond with the reinforcement ribs, the structural bond is further reinforced. In the case of seats for those pins which are particularly stressed, the metal structure is made to continue to the interior of the side walls, and passages 21 for these pins are provided such as to transfer the load directly to the metal, hence stressing the plastic structures to a lesser extent.

To form the structure, the flanged socket is placed in a mould 32, then the plastic is injected thereon to form the box support at the end of the injection process. The base of the mould is provided with positioning pegs 34 which maintain the flanged socket raised from the mold base.

It is apparent from the foregoing description that the structure of the invention presents numerous advantages, and in particular that structure:

- can be formed easily and comfortably by an injection molding operation,
- avoids the use of additional components such as bushes, screws and pins, has the necessary strength to pass the regulation tests, has fewer design constraints on the shape to be used, can be easily industrialized, and is of low cost as all work subsequent to its formation is eliminated.

The invention claimed is:

1. A connecting structure between a support column and a seating portion within an office chair comprising:

a tray-shaped body made of a plastic material; and a socket made of a metallic material and comprising a frusto-conical portion and a flange that are fixedly coupled to the tray shaped body, the frusto-conical portion forming a seat which is configured for insertion-fitting of said support column for the seating portion, the flange having a plurality of through-holes defined therein, wherein the socket is fixedly coupled to the tray-shaped body by having the frusto-conical portion inserted into an opening in the tray-shaped body and the plastic material coupled to an outer wall of the frusto-conical portion and by further having the flange embedded in the plastic material, the plastic material penetrating through the through-holes of the flange.

2. The connecting structure as claimed in claim 1, further comprising reinforcement ribs which connect the frusto-conical portion of the socket to side walls of the tray-shaped body.

3. The connecting structure as claimed in claim 2, wherein the reinforcement ribs are disposed in the tray-shaped body to extend over the through-holes in the flange.

4. The connecting structure as claimed in claim 1, wherein the tray-shaped body comprises a member extending therefrom that enables coupling the tray-shaped body with a control lever of the office chair by direct insertion of the member into the control lever.

5. The connecting structure as claimed in claim 1, further comprising wall sockets that are disposed in a side wall of the tray-shaped body and are configured to house pins coupled to adjustment members of the office chair.

* * * * *